United States Patent [19]

Offutt et al.

[11] 3,962,617

[45] June 8, 1976

[54] CURRENT LIMITING IMPEDANCE NETWORK FOR DRYER CONTROL

[75] Inventors: Carl R. Offutt, St. Joseph; Roque Denis Marcade, Stevensville, both of Mich.

[73] Assignee: Whirlpool Corporation, Benton Harbor, Mich.

[22] Filed: Jan. 6, 1975

[21] Appl. No.: 539,018

[52] U.S. Cl. ..... 318/444; 318/483; 34/45; 318/501

[51] Int. Cl.[2] ..... H02P 1/04

[58] Field of Search ..... 318/443, 444, 483, 501; 34/45

[56] References Cited

UNITED STATES PATENTS

| | | | |
|---|---|---|---|
| 3,460,267 | 8/1969 | Lorenz | 318/483 X |
| 3,471,939 | 10/1969 | Janke | 318/483 X |
| 3,521,376 | 7/1970 | Beller | 318/483 X |
| 3,714,717 | 2/1973 | Beard, Jr. et al. | 318/483 X |

*Primary Examiner*—Gene Z. Rubinson
*Attorney, Agent, or Firm*—Hill, Gross, Simpson, Van Santen, Steadman, Chiara & Simpson

[57] ABSTRACT

A current limiting impedance network for a dryer control in which a controlled conduction device, such as an SCR, is connected to shunt an AC motor to selectively prevent operation of the motor, in which a current limiting, power dissipating resistor is replaced by a lower value and lower power rating resistor and a capacitor connected in series with the resistor. The capacitor has a capacitive reactance of a value approximately twice the inductive reactance of the motor to provide substantially the same magnitude of circuit impedance as with the current limiting power resistor and cause operation of the circuit with a leading rather than a lagging current phase angle.

5 Claims, 5 Drawing Figures

L1
N
L2
DOOR SWITCH
52
10
46
48
32
20
18
50
44
40
24
22
42
30
28
38
78
76
74
54
72
66
70
68
64
62
26
58
56
60
36
34
12
16
14

CURRENT LIMITING IMPEDANCE NETWORK FOR DRYER CONTROL

BACKGROUND OF THE INVENTION

1. Field of the Invention

This invention relates to a control for an automatic dryer, and more particularly to a current limiting network for such a control.

2. Description of the Prior Art

Donald E. Janke discloses an electronic control circuit for a dryer in U.S. Letters Pat. No. 3,471,939, issued Oct. 14, 1969 and assigned to Whirlpool Corporation, in which a timer motor of a dryer control is rendered inoperative by a shunt connected SCR in the absence of a predetermined dryness condition which is sensed by a moisture sensing circuit. In circuits of this type it has been the practice to provide a power resistor as a current limiting means for the DC current through the SCR when the SCR is conductive. This power resistor is relatively large, for example 720 ohms, 14 watts, and generates a great deal of heat which prevents mounting of the resistor in direct contact with the printed circuit board which carries other associated circuit components. In order to prevent damage to the circuit board and to the other components from the heat generated by the resistor, it has been necessary to mount the resistor either above the printed circuit board with special terminals and standoffs, or in a separate location with electrical connections extended thereto by way of spade type harness connections or the like. Problems have also been encountered in obtaining adequate quantities of reliable resistors of this type at costs which would be low enough to allow utilization of these resistors in consumer products.

Other dryer control circuits also utilize an SCR triggered by a sensor circuit to control operation of a timer motor. For example, attention is invited to U.S. Pat. Nos. 3,707,776; 3,471,938; and 3,765,100. In each of these circuits, however, the SCR is connected in series with the timer motor and does not require a current limiting means in the circuit.

U.S. Pat. No. 3,621,293 discloses the connection of an SCR in series with a coil and a dryer control circuit to control the operative state of the coil. A resistor and a capacitor are connected in series with the SCR to aid the coil in maintaining associated switches closed during conduction of the SCR when the coil is only receiving half-wave power.

SUMMARY OF THE INVENTION

It is therefore the primary object of the invention to provide an improved current limiting arrangement for a controlled conduction device in a dryer control circuit in which the controlled conduction device is operated to shunt a motor of the dryer control.

A more specific object of the invention is to provide an improved current limiting arrangement for an SCR in a dryer control in which the SCR is rendered conductive to shunt half of the supply wave around a timer motor, and in which the current limiting arrangement has an energy storage buildup time in order to maintain the current through the SCR above the value of its holding current.

According to the invention, a circuit connected across a timer motor of a dryer control includes a controlled conduction device, in particular an SCR, connected in parallel with the timer motor, and includes a gate electrode which receives potentials from a moisture sensing circuit to maintain the SCR conductive, while the sensed moisture content of the clothes in the dryer is above a predetermined value. A current limiting means is connected in series with the SCR to limit the current therethrough while the SCR is in its conductive state. Heretofore, the current limiting means have comprised a relatively large resistor having a high power rating, e.g. 720 ohms, 14 watts, and due to the resistive-inductive nature of this resistor together with the inductance of the timer motor the circuit had an inductive impedance. In the present invention, the power resistor is replaced by a resistor-capacitor combination in which the resistor is relatively small, e.g. 220 ohms, ½ watt, and the capacitor has a capacitive reactance of approximately twice the inductive reactance of the timer motor. As a result, when the SCR is not conducting the total circuit impedance is capacitive and operates with a leading power factor, but the magnitude of the circuit impedance is substantially unchanged.

The values of the resistor and capacitor are selected so as to provide an RC time constant which is sufficiently long that the capacitor will not charge quickly enough to drop the current below the minimum holding current necessary to maintain the SCR in conduction for the duration of the half line cycle. With a 220 ohm, ½ watt resistor and a line supply of 125 volts, 60 Hz, a capacitance of 0.33 microfarads was found to be appropriate for one particular type of timer motor design.

BRIEF DESCRIPTION OF THE DRAWING

Other objects, features and advantages of the invention, its organization, construction and operation will be best understood from the following detailed description of a preferred embodiment thereof taken in conjunction with the accompanying drawings of which

DESCRIPTION OF THE PREFERRED EMBODIMENT

Figure 1:
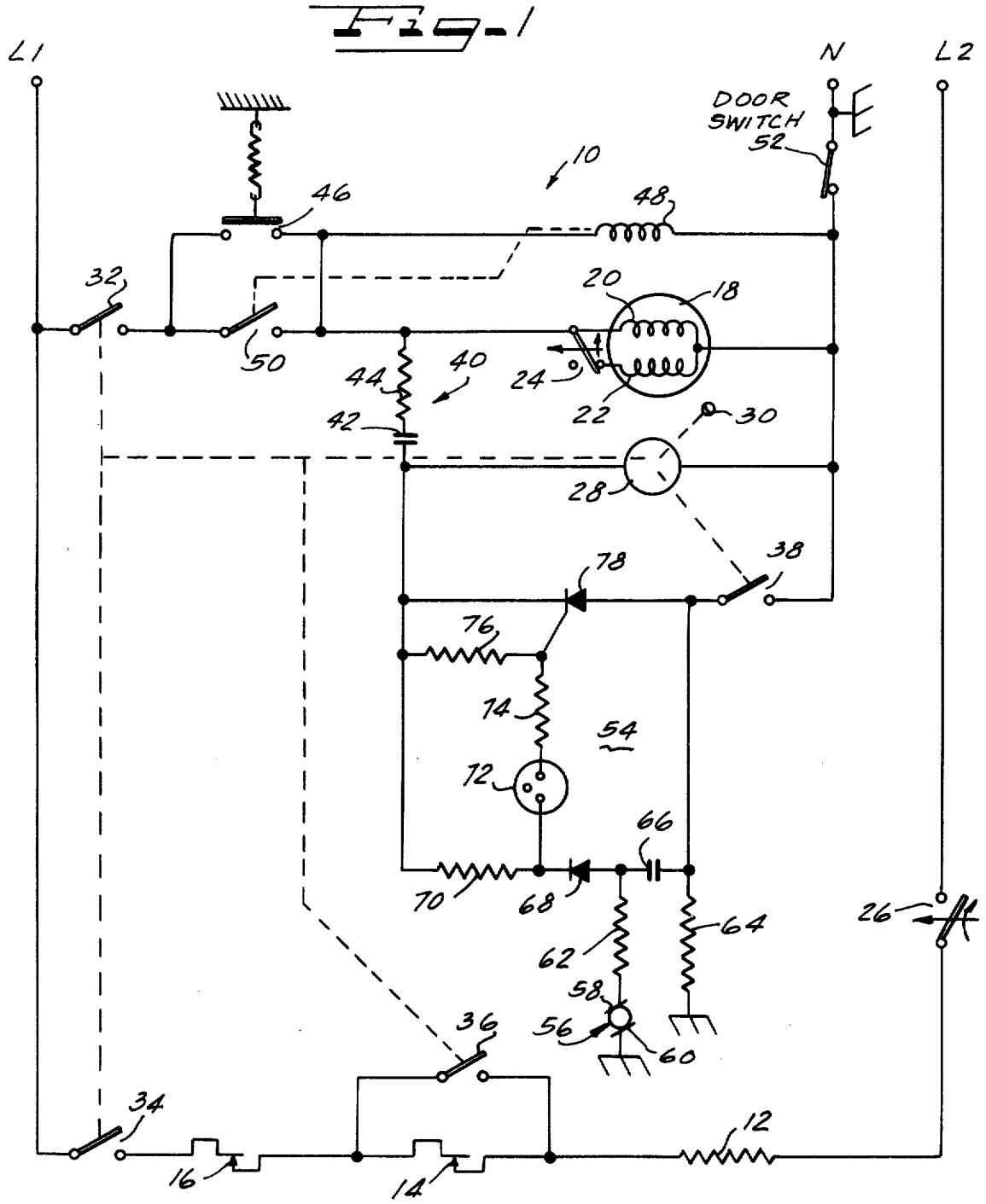
FIG. 1 is a simplified circuit schematic diagram of a dryer circuit in accordance with the present invention.

Referring to the drawing of FIG. 1, a dryer circuit is schematically illustrated as comprising a plurality of input terminals L1, N and L2, which are connected to a conventional supply line such that 230 volts, 60 Hz is connected across the terminals L1, L2, and 125 volts, 60 Hz is connected across the terminals L1 and N, for example.

The terminals L1 and L2 constitute terminals of the heating circuit of the dryer which includes a heater 12 and a pair of thermostat switches 14 and 16 which are connected in series between the terminals L2 and L1 by way of respective switches 26 and 34 which are operated by other circuit components, as will be discussed below.

The dryer control further comprises a drive motor 18 which is coupled to a rotatable drum (not shown), and is connected between the terminals L1 and N. The drive motor 18 comprises a running winding 20, a starting winding 22 connected in parallel with the running winding by way of a centrifugally operated switch 24, and the centrifugally operated switch 26 which connects the heater 12 to the terminal L2 when the motor 18 reaches a predetermined speed. The switch 24, also a centrifugally operated switch, opens the circuit to the starting winding 22 when the motor reaches a predetermined rotational speed.

A dryer programmer, including a timer motor 28 and a plurality of contacts 32–38 controlled thereby, controls operation of the dryer through a predetermined sequence of operation. A manually operated knob 30 is mounted on a console (not shown) of the dryer for selectively presetting the programmer to a desired drying cycle, as is well known to those versed in this art.

A push-to-start switch 46, also usually mounted on the console of the dryer, is connected to the terminal L1 by way of the timer contact 32 and to the terminal N by way of a relay winding 48 and a door operated switch 52 which is closed in response to closing of the dryer access door. The relay winding 48 operates a relay contact 50 associated therewith to bypass the push-to-start switch 46 after the initiation of operation of the dryer thereby maintaining continuity to the winding until contact 32 is opened by the timer at the end of the cycle, or the door switch 52 is opened by the dryer door.

The timer motor 28 has an SCR 78 connected in parallel therewith by way of the timer contact 38 during an automatic moisture sensing portion of a drying cycle during which the conductive state of the SCR 78 is controlled by a moisture sensing circuit 54.

The moisture sensing circuit 54 includes a moisture sensor 56 which is mounted in functional proximity to the interior of the drum and which has an electrode 60 connected to ground and an electrode 58 connected to the anode of a diode 68 by way of a resistor 62. The anode of the diode 68 is connected to ground by way of a resistor 64 and a capacitor 66 and is connected to the terminal N by way of the capacitor 66, the timer contact 38 and the door switch 52. The cathode of the diode 68 is connected to the cathode of the SCR 78 by way of a resistor 70, and is connected to the gate electrode of the SCR 78 by way of a neon lamp 72 and a resistor 74. The gate of the SCR 78 is also connected to its cathode by way of a resistor 76.

The circuitry shown in FIG. 1 including the moisture sensing circuit 54 operates generally as follows. Line voltage is applied between the terminals L1 and N causing a first voltage drop across the series-connected, power dissipation reactance impedance components, the resistor 44 and the capacitor 42. Another voltage drop occurs across the resistor 70 which is connected in parallel with the resistors 76, 74 and the neon lamp 72. A third voltage drop occurs across the series-connected resistor 62 and the moisture sensor 56 which are, in turn, connected in parallel with the series-connected resistor 64 and the capacitor 66.

At the beginning of a drying operation when the clothes dryer controlled by this circuitry is loaded with wet clothing to be dried, the voltage drop across the resistor 62 and the moisture sensor 56 is low (because the resistance across the sensor 56 is low) while the voltage drop across the resistor 70 is relatively high. When this relatively high voltage is applied across the neon lamp 72 and the resistor 76 and 74 connected in series therewith, the neon lamp 72 is caused to fire each line cycle thus rendering the SCR 78 conductive and thereby shunting half-wave voltage across the timer 28 causing it to remain deenergized.

During the initial drying stages when wet fabrics continually bridge the sensor terminals 58 and 60 of the moisture sensor 56, this action is repetitive during each negative half of the voltage line cycle thereby causing the timer motor 28 to be shunted during alternate half cycles of the voltage supply wave. The timer motor 28 is of a type, for example a hysteresis motor, which will not operate in response to half-wave voltage and therefore will not advance substantially until the moisture sensor 56 and its associated moisture sensing circuit 54 determine that the overall moisture content of the fabrics being dried has decreased to a predetermined level.

As the clothing contacting the moisture sensor 56 dries and thereby increases in resistance, the resistance across the sensor 56 also increases which causes an increasing voltage drop across the series-connected resistor 62 and the sensor 56. That voltage increase in one part of the overall voltage divider network thus provided between the lines L1 and N causes a decrease in the voltage drop across the resistor 70 and hence across the neon lamp 72. The decreasing voltage applied to the neon lamp 72 progressively decreases to voltage levels below the firing voltage level of the neon lamp 72 causing it to progressively fire less frequently than before which allows the timer 28 to be intermittently energized at an increasing frequency.

When the clothing or other fabrics contacting the moisture sensor 56 are dry, the voltage drop across the series-connected resistor 62 and the moisture sensor 56 will be high while the voltage across the resistor 70 will be low so that the neon lamp 72 will not fire. This causes the SCR 78 to remain non-conductive so that full wave voltage will be applied to the timer 28 causing it to remain energized and run out to thereby terminate the fabric drying cycle of the clothes dryer.

Prior art circuits of interest to the control circuit 54 disclosed herein are shown in U.S. Pat. Nos. 3,522,660 (Elders), 3,714,717 (Beard et al), 3,471,938 (Elders) and 3,471,939 (Janke), all of which have been assigned to Whirlpool Corporation. The line dropping resistors $R_1$ of Elders U.S. Pat. No. 3,522,660 and 55 of Beard et al represent the type of resistance that the current limiting reactive impedance network of this invention is intended to replace.

In order to operate the dryer, an operator loads the rotatable drum with wet fabric, closes the door to activate the door switch 52, rotates the knob 30 to the desired drying cycle (which will close the main power contact 32), and presses the push-to-start switch 46. The relay winding 48 becomes energized to close the contact 50 which maintains power to relay winding 48 and places the drive motor 18 across the terminals L1 and N. The drive motor 18 begins to rotate and upon reaching a predetermined speed of rotation, the switch 24 opens to remove the starting winding 22 from the circuit and switch 26 closes to connect the heater 12 to the terminal L2. The dryer will then operate in accordance with the program selected by the operator in selectively setting the programmer with the knob 30.

During an automatic moisture sensing cycle, the moisture sensor 56 in conjunction with the sensing circuit 54 renders the SCR 78 conductive during alternate half cycles until a predetermined overall moisture content is achieved.

During conduction of the SCR 78, the impedance of the timer motor is shunted; therefore, a current limiting means 40 is required to limit the current through the SCR 78. Heretofore, a relatively large power resistor, for example 720 ohms, 14 watts, was used for this purpose. The present invention, however, utilizes a reactive impedance network comprising a capacitor 42 connected in series with a relatively smaller resistor 44 for this purpose.

The impedance network is designed such that the capacitor 42 has a capacitive reactance which is approximately twice or somewhat more than twice the inductive reactance of the timer motor 28, and the resistor 44 is of a much lower resistance value than the power resistor previously used. Therefore, the magnitude of the total circuit impedance is substantially the same (when the SCR is not conducting) as with the power resistor; however, the impedance includes a capacitive (rather than inductive) reactance and the circuit operates with a leading, rather than a lagging, power factor.

Figure 2:
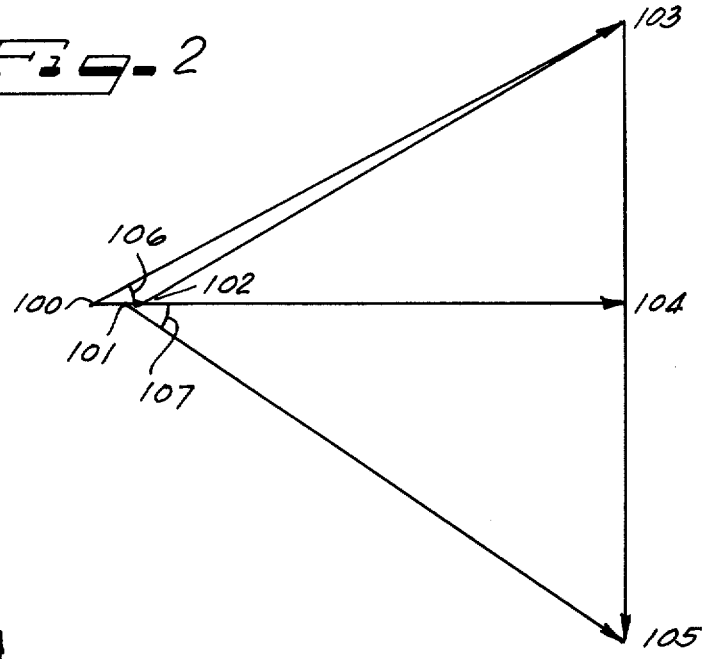
FIG. 2 is a vector diagram of steady-state impedances for a dryer control circuit.

For a consideration of the circuit of FIG. 1 when the SCR 78 is not rendered conductive by the sensor circuit 54 so that the timer motor is running, refer to the vector diagram of FIG. 2; the resistive portion of the timer motor impedance is represented by the vector 102–104; the inductive reactance of the timer motor impedance is represented by the vector 104–103; and the resistance of a relatively large power resistor (as was used in circuits of the type shown in FIG. 1 prior to the present invention) is represented by the vector 100–102. Thus the approximate total impedance of the circuit including the timer motor is represented by the vector 100–103 (the sum of vectors 102–104, 104–103, and 100–102). In order to substitute a current-limiting impedance network including a capacitor and a relatively small resistor for the relatively large power resistor without substantially changing the magnitude of the circuit's total impedance the capacitor selected must have a capacitive reactance (shown as the vector 103–105 in FIG. 2) of approximately twice the inductive reactance of the timer motor. It will also be seen from FIG. 2 that in order to reduce the magnitude of the power resistor vector 100–102 to a smaller value (resistor vector 101–102) which consumes less power and maintain the same magnitude of circuit impedance (vector 101–105 as compared with the power resistor circuit impedance vector 100–103) the capacitive reactance 103–105 must be on the order of 10 percent greater than twice the inductive reactance of the timer motor. It will be appreciated, however, by one skilled in the art that a timer motor will normally operate satisfactorily in a number of different circuits representing a range of circuit impedances. In any event, a satisfactory current-limiting impedance network according to the present invention will provide approximately the same total circuit impedance as was present in the circuit including the relatively large power resistor, with the phase angle 107 (see FIG. 2) for the improved circuit being approximately the same as that for the earlier circuit (phase angle 106 in FIG. 2) but with the opposite sign (a leading rather than a lagging power factor). Allowing the capacitor 42 to charge too quickly during conduction of the SCR 78 could permit the current through the SCR to drop to a value which is below the minimum holding current of the SCR. This would cause the SCR 78 to become nonconductive and thereby open the shunt across the timer motor 28 and permit the timer motor to run. In order to prevent such an occurrence, the values of the capacitor 42 and the resistor 44 are chosen, as mentioned above, so as to provide an RC time constant that is long enough that the SCR 78 will be held in conduction for the full half-wave of the AC line cycle once it has been rendered conductive.

For purposes of this invention the capacitor 42 may advantageously have a value of 0.33 microfarads and the resistor a value of 220 ohms (½ watt) where a magnetic synchronous timer motor (for example, a Mallory M004 model) is used.

Figure 3A:
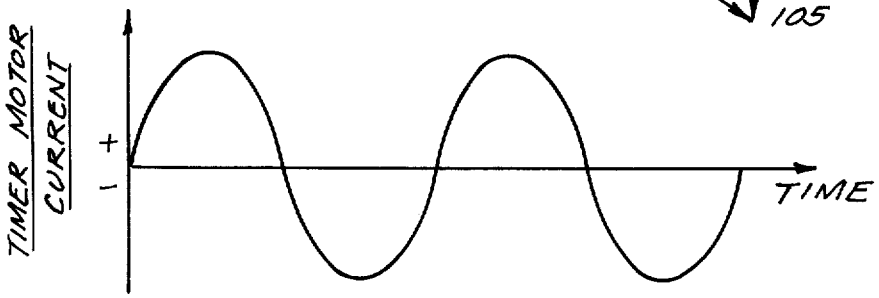
FIGS. 3*a*–3*c* are plots of current versus time for a portion of a dryer control under certain clothes and circuit conditions.
Figure 3B:
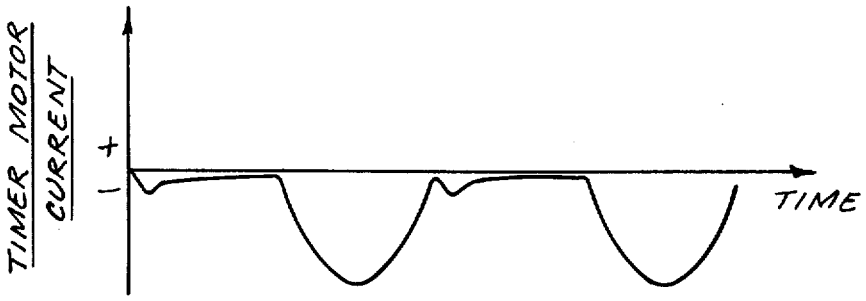

Referring now to FIGS. **3*a*–3*c*, these figures each represent a plot of current to the timer motor of a dryer control as described above as a function of time for a period equal to two line cycles. FIG. 3*a* describes this current-time relationship for the dry-clothes condition during which the SCR (see FIG. 1**) is "off" or non-conductive. For this condition the timer motor sees the full current wave form and will run continuously.

FIG. **3*c* is a plot similar to that of FIG. 3*a* for a wet-clothes condition. Here the current limiting impedance network is in accordance with the present invention but has a short RC time constant. It will be seen from FIG. 3*c* that although the SCR is triggered, its holding current is not maintained throughout the one-half line cycle period. Consequently, the wave form seen by the timer motor includes a substantial positive component 110,** and the timer motor may run either intermittently or continuously.

Figure 3C:
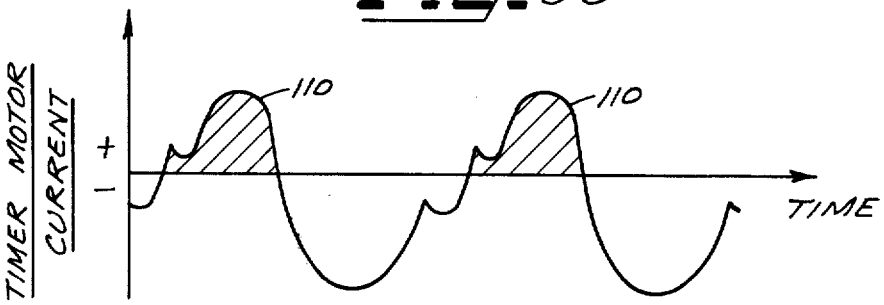

FIG. **3*b* is a plot similar to that of FIG. 3*c* (wet-clothes condition), but here the resistor 44 and the capacitor 42 (see FIG. 1) are selected to have values providing an RC time constant which is long enough that the SCR 78** will be held conductive for substantially the entire half-wave portion of the AC line cycle. Thus, this circuit represents values of resistance and capacitance specifically for a circuit according to the teaching of the present invention; and the current wave form seen by the timer motor includes no positive component. The timer motor is thus stalled since it cannot run on half-wave current.

The invention therefore provides for the utilization of a very low dissipation element, a capacitor, in series with a relatively small resistor in place of a highly rated power resistor for limiting the forward current through the SCR. Advantageously, little heat is generated by these components in comparison to the prior arrangement so that the components may be mounted along with the other components on a printed circuit board. Also advantageous is the fact that the remainder of the circuit remains the same in that the total impedance is the same, only capacitive rather than inductive, so that no change in the timer motor is required. In summary, the primary advantages of the reactive network are lower costs, easier assembly and high reliability, and all of these advantages are associated with the fact that the reactive network dissipates very little power and utilizes, for example, a ½ watt composition resistor and a polyester film capacitor, low cost items which facilitate assembly and improved reliability.

Although we have disclosed our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

The embodiments of the invention in which an exclusive property or privilege is claimed are defined as follows:

1. In an automatic clothes dryer of the type having a control circuit wherein an AC motor which is connected to an AC electrical supply is shunted by a controlled conduction device to selectively shunt one half of the AC wave to prevent operation of the motor, and a current limiting means is connected in series circuit with the controlled conduction device and the motor to limit the current through the controlled conduction device during its conductive condition, the improvement wherein:

said current limiting means comprises a resistor and a capacitor connected in series with said resistor, said capacitor having a capacitive reactance which is approximately twice the inductive reactance of the motor to provide a capacitive circuit impedance and operation of the circuit with a leading current phase angle.

2. The improvement set forth in claim 1, wherein said resistor and said capacitor have a time constant sufficient to maintain the current through the controlled conduction device above its holding value for the duration of each of said one half of said AC waves to prevent turn-off of the controlled conduction device and energization of the motor.

3. An automatic clothes dryer comprising:

a timer motor for connection to an AC electrical supply, said timer motor being incapable of operation in response to half-wave energization;

an SCR connected in parallel with said timer motor and including a gate for receiving gate signals for rendering said SCR conductive;

circuit means connected to said gate and repetitively providing gate signals thereto to render said SCR conductive during alternate half cycles of the AC wave; and current limiting means connected in series with said SCR, said current limiting means including a resistor, and a capacitor connected in series with said resistor and having a capacitive reactance substantially equal to twice the inductive reactance of said timer motor.

4. An automatic clothes dryer according to claim 3, wherein said resistor and said capacitor have an RC time constant sufficiently long to prevent charging of the capacitor at a rate which would reduce the current through the SCR to a value below its holding current during said alternate half cycles.

5. A control circuit for controlling operation of an automatic clothes dryer, said control circuit comprising:

a timer motor for energization by an alternating current electrical supply having a full wave form including a positive half-wave component and a negative half-wave component, said timer motor requiring both said positive and said negative components to be operative;

a sensor circuit responsive to the dryness condition of clothes being dried to provide pulses;

an SCR connected across said timer motor and including a gate for receiving said pulses and triggering said SCR conductive in response to said pulses, said SCR shunting one of said half-wave components across said timer motor while said SCR is conductive; and current limiting means including an impedance network connected in series with said SCR and said timer motor, said impedance network including a resistor and a capacitor connected in series with said resistor, said control circuit without said impedance network having a first steady state impedance and a lagging power factor and said control circuit including said impedance network having leading power factor and a second steady state impedance substantially equal in magnitude to said first steady state impedance, said impedance network having an RC time constant sufficiently long to prevent said capacitor being charged at a rate causing said SCR to be rendered non-conductive during the period of said one of said half-wave components.

* * * * *